US010688324B2

(12) United States Patent
Chiang

(10) Patent No.: US 10,688,324 B2
(45) Date of Patent: Jun. 23, 2020

(54) NOSE CLIP STRUCTURE

(71) Applicant: Global Esprit Inc., New Taipei (TW)

(72) Inventor: Herman Chiang, New Taipei (TW)

( * ) Notice: Subject to any disclaimer, the term of this patent is extended or adjusted under 35 U.S.C. 154(b) by 191 days.

(21) Appl. No.: 15/955,744

(22) Filed: Apr. 18, 2018

(65) Prior Publication Data

US 2019/0290941 A1 Sep. 26, 2019

(30) Foreign Application Priority Data

Mar. 23, 2018 (TW) ..... 107203844 U

(51) Int. Cl.
*A62B 9/06* (2006.01)
*A63B 33/00* (2006.01)

(52) U.S. Cl.
CPC ..... *A62B 9/06* (2013.01); *A63B 33/00* (2013.01)

(58) Field of Classification Search
CPC ..... A62B 9/06; A62B 23/06; A61M 16/0666; A61F 5/08; A61F 5/56; A61F 2/18; A61F 2/186; G02C 5/12–128; B63C 2011/125
See application file for complete search history.

(56) References Cited

U.S. PATENT DOCUMENTS 1,950,839 A * 3/1934 Chirila ..... A61F 5/08 606/199
2,015,617 A * 9/1935 Claudius ..... A62B 9/06 606/157
2,610,624 A * 9/1952 Haller ..... A62B 18/00 128/205.29
3,266,490 A * 8/1966 Klinger ..... A62B 18/00 128/206.15
4,231,360 A * 11/1980 Zloczysti ..... A62B 9/06 128/201.18
5,103,813 A * 4/1992 Hart ..... A63B 33/00 128/200.24
5,133,347 A * 7/1992 Huennebeck ..... A62B 7/08 128/201.18
5,464,413 A * 11/1995 Siska, Jr. ..... A61B 17/122 606/151
6,561,184 B2 * 5/2003 Chiang ..... A62B 9/06 128/201.18
2002/0020411 A1 * 2/2002 Resnick ..... A62B 9/06 128/201.18
2005/0011524 A1 * 1/2005 Thomlinson ..... A61M 16/0666 128/207.18
2006/0206120 A1 * 9/2006 Clawson ..... A61C 19/05 606/151
2014/0296904 A1 * 10/2014 Andre ..... A61F 5/08 606/199

* cited by examiner

*Primary Examiner* — Valerie L Woodward

(57) ABSTRACT

A nose clip structure includes a nose frame and nose pads. The nose frame includes two arms and a connecting portion. The connecting portion interconnects the two arms to make the two arms bend flexibly. The nose pads are disposed on the two arms of the nose frame, and has an anti-off body adapted to engage with the wing of the swimmer's nose for preventing falling-off of the nose clip structure.

6 Claims, 9 Drawing Sheets

NOSE CLIP STRUCTURE

BACKGROUND OF THE INVENTION

1. Field of the Invention

The present invention relates generally to a nose clip structure and in particular to a nose clip structure which is adapted to engage a swimmer's nose in order to limit exposure of a swimmer's nasal cavity to water and is capable of providing a secure and comfortable fit to the swimmer's nose.

2. Related Art

As known, nose clips have been designed for use by swimmers in order to limit exposure of the swimmer's nasal cavity to water, as a kind of auxiliary tools in swimming. In general, it is commonly used by water ballet dancers or people who are learning how to swim. The nose clip is to provide a sufficient clamping force to be held on the swimmer's nose, and the clamping force should not be too large, otherwise the swimmer may feel uncomfortable.

Conventional nose clip is designed in a U shape, so the arms on both sides of the U shape can corporately clip on to the swimmer's nose. However, the wearing comfort of the nose clip is also important. If the nose clip makes the swimmer feel uncomfortable or even causes harm after worn, then it cannot be a satisfactory tool. Therefore, the development has created a soft material cladding on the U-shape clip, or soft pads disposed on the both arms of the U-shape clip where the swimmer's nose comes in touch, for propose of providing a compliant engagement with the swimmer's skin. However, the soft material cladding on the U-shape clip or the soft pads disposed on the both arms of the U-shape clip still provide an unfavorable hard elasticity in contact with the swimmer's nose, because the both arms of the U-shape clip fail to fit to the contour of the swimmer's nose. That is, the contour of the both arms does not correspond with the swimmer's nose being wide at the top and narrow at the bottom, so that the swimmer may feel uncomfortable, and feel pain especially on the spot of the nose bridge where the both arms of the U-shape clip come in touch. Furthermore, when fastened on the swimmer's nose, the soft pads, along with the both arms of the U-shape clip, may cause looseness during swimming, because the both arms do not match the contour of the swimmer's nose. The swimmer's nose is as if a hill having sides sloped down from the center at which the unfavorable looseness occurs. The higher the swimmer's nose, the easier the looseness of the nose clip occurs.

SUMMARY OF THE INVENTION

An object of the present invention is to provide a nose clip structure which has a contour capable of being compliance with the swimmer's nose that has a wide top and a narrow bottom, to provide a comfortable fit to a swimmer's nose, and which has an anti-off body that has, for example, a sucking function to provide a secure fit to a swimmer's nose.

To achieve the object, a nose clip structure in accordance with the present invention comprises a nose frame and nose pads. The nose frame includes two arms and a connecting portion. The connecting portion interconnects the two arms to make the two arms bend flexibly. The nose pads are disposed on the two arms of the nose frame, and has an anti-off body adapted to engage with the wing of the swimmer's nose for preventing falling-off of the nose clip structure.

Accordingly, the anti-off body is a sucker or has an uneven surface or a grainy surface capable of adding friction.

Accordingly, the nose pads are disposed in the mounting grooves of the two arms, wherein the nose pads are integrally formed on the two arms in an over-molding injection mode or in a dual-injection mode.

Accordingly, the two arms are disposed with the nose pads, wherein a free end of each of the two arms is disposed with the mounting groove, the mounting groove is composed of a through lane and a hole formed integrally with the through lane. The through lane has an opening, and each of the nose pads is disposed with a pillar and a head. The pillar is assembled with the through lane, and the head is formed integrally with the pillar. The anti-off body is a sucker. The sucker has a base integrally extended from the pillar and has an arc pad formed integrally with the base, and the arc pad has a recess.

Accordingly, the two arms, along with the connecting portion, form an arc contour that has a wide top and a narrow bottom, and each of the two arms is shaped as an oblique arc, which enhances the flexibility of the two arms during bending, so as to provide a comfortable fit to the swimmer's nose.

DESCRIPTION OF THE INVENTION

Figure 1A:
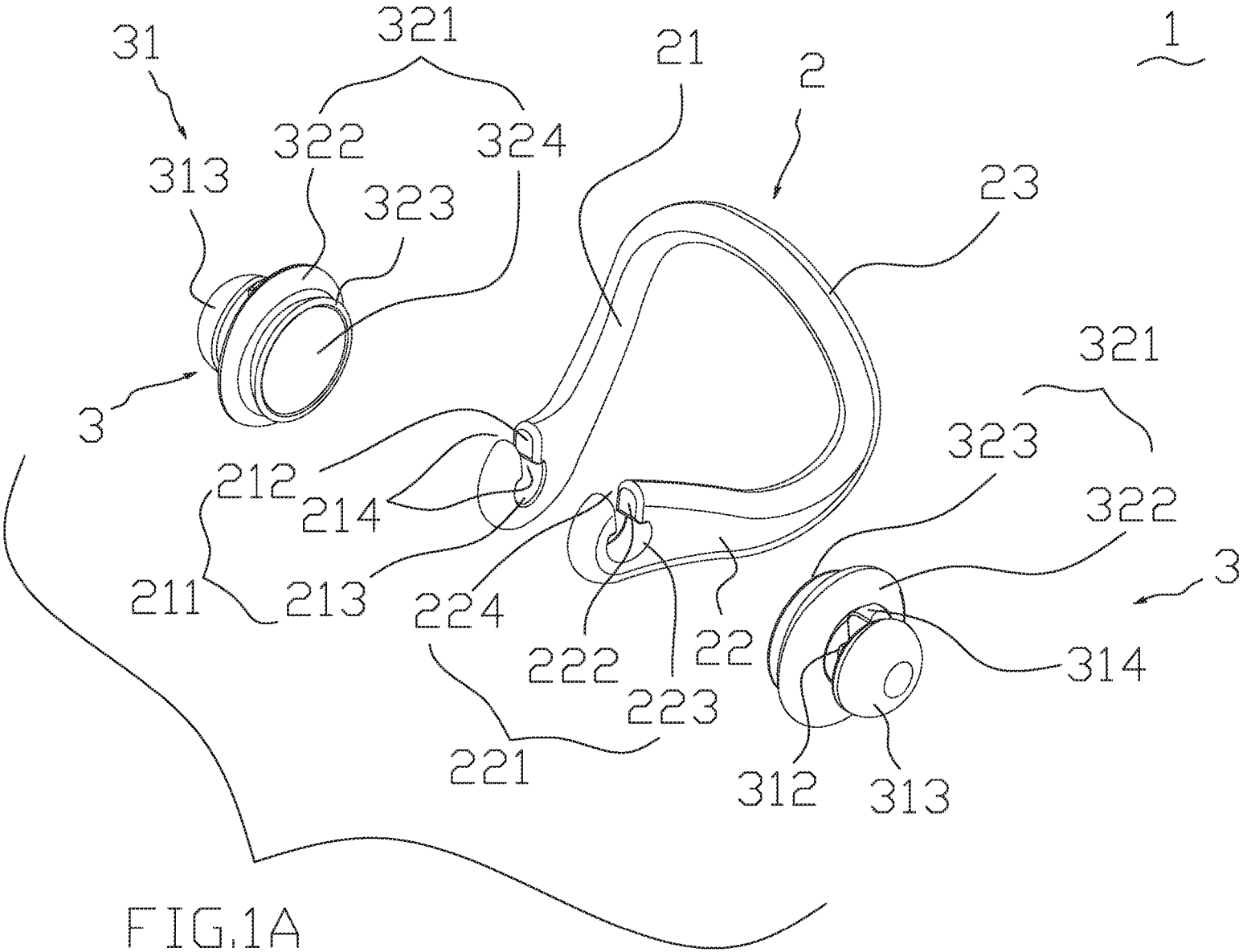
FIGS. 1A and 1B are exploded perspective views showing a first embodiment of the nose clip structure in accordance with the present invention from different view angles.
Figure 1B:
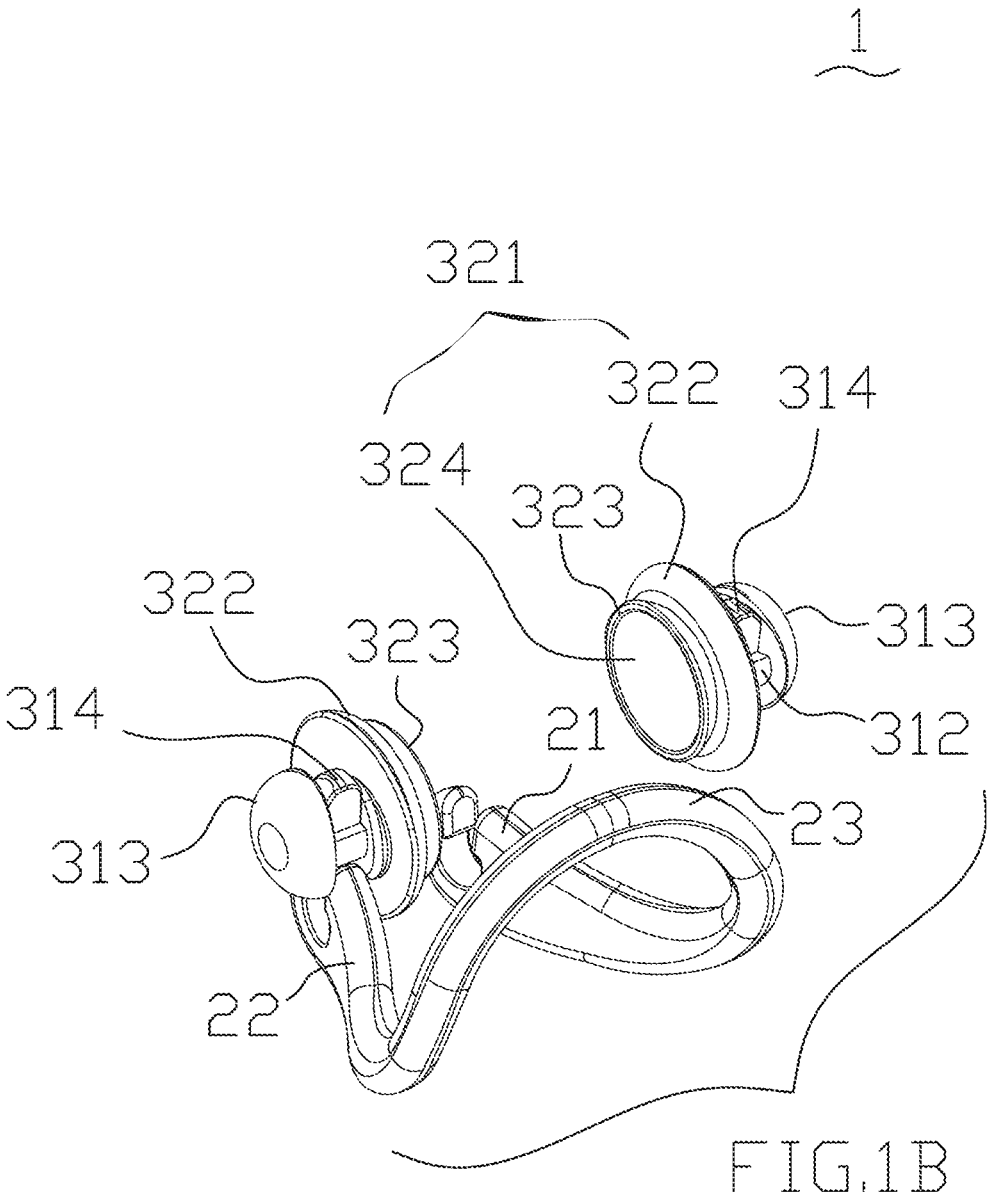

Referring to FIGS. 1A and 1B, a nose clip structure 1 in accordance with a preferred embodiment of the present invention, includes a nose frame 2 and nose pads 3. The nose frame 2 is made of nylon and comprises two arms 21,22 and a connecting portion 23. Each of the two arms 21,22 is shaped as an oblique arc. A free end of each of the two arms 21,22 is disposed with a mounting groove 211,221. The mounting groove 211,221 is composed of a through lane 212,222 and a hole 213,223 formed integrally with the through lane 212,222. The through lane 212,222 has an opening 214,224. A width of the through lane 212,222 is small than an inner diameter of the hole 213,223. The connecting portion 23 interconnects the two arms 21,22 and allows the two arms 21,22 to relatively bend in a flexible manner. The two arms 21,22, along with the connecting portion 23, form an arc contour that has a wide top and a narrow bottom, which enhances the flexibility of the two arms 21,22 during bending, so as to provide a comfortable fit to a swimmer's nose.

Figure 5A:
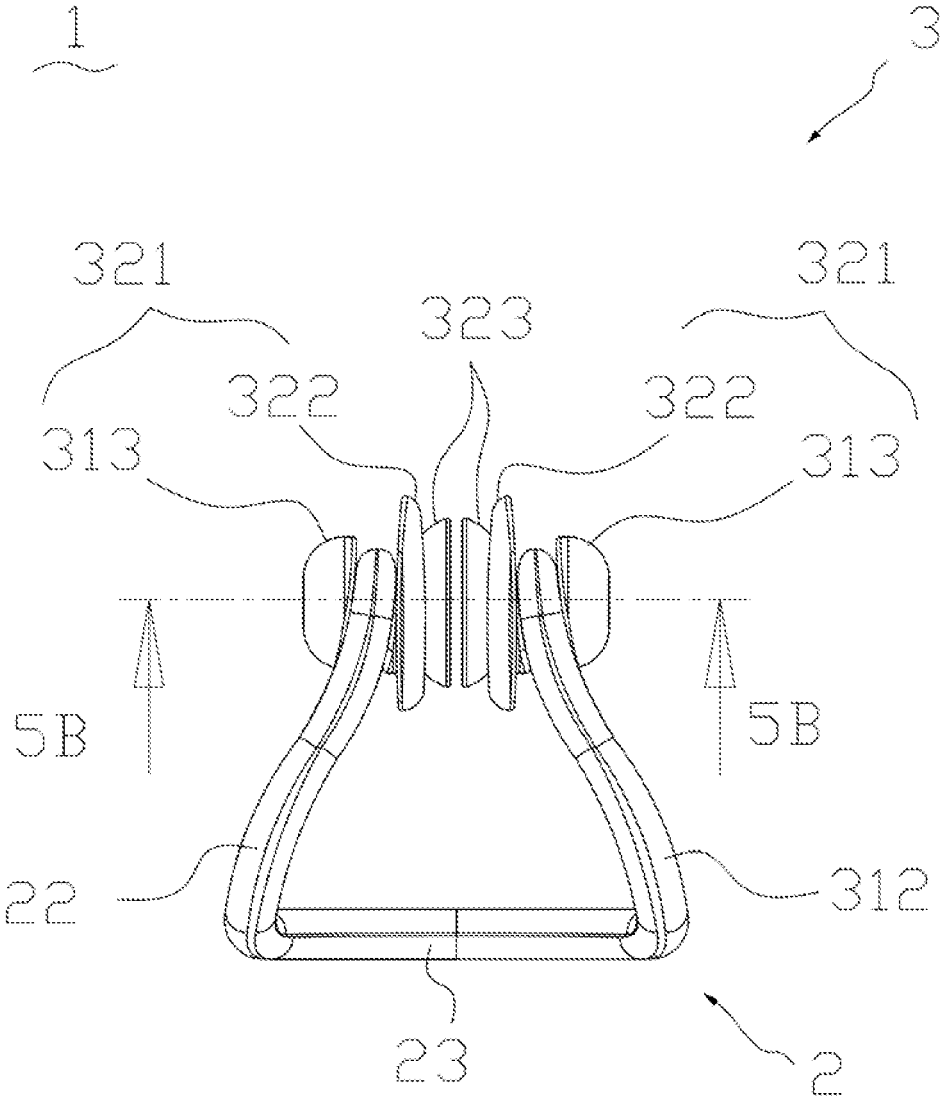
FIG. 5A is a front view showing the nose clip structure in accordance with the present invention from a different view angle.
Figure 5B:
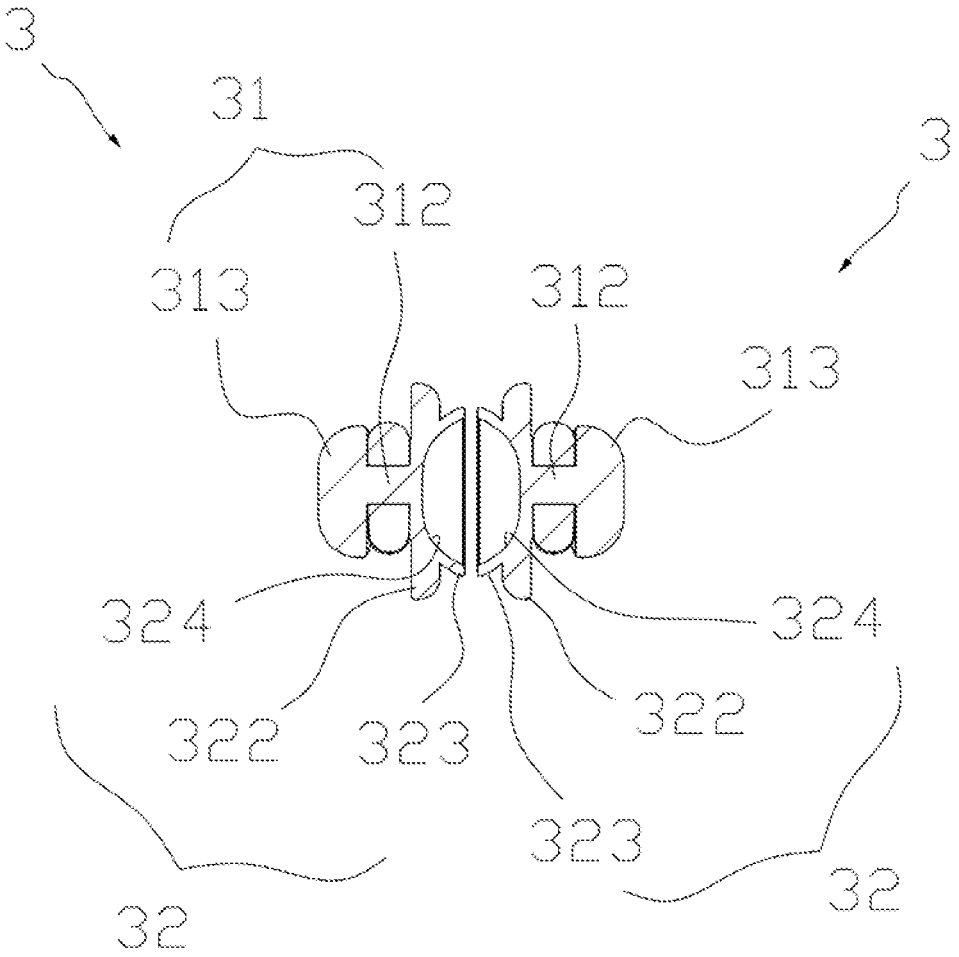
FIG. 5B is a cross-sectional view taken along line 5B-5B of FIG. 5A.

The nose pads 3 are made of a soft material such as thermoplastic rubber or silicon. With further reference to FIGS. 5A and 5B, the nose pads 3 are configured on the mounting grooves 211,221 of the nose frame 2. Each of the nose pads 3 has a pillar 312, a head 313 formed integrally with the pillar 312, and an anti-off body 321 adapted to engage with the wing of the swimmer's nose for preventing falling-off of the nose clip structure 1. A longitudinal sectional width of the pillar 312 is slightly larger than a width of the through lane 212,222. A cross sectional width of the head 313 is larger than an inner diameter of the hole 213,223 of the through lane 212,222. The pillar 312 is disposed with a bump 314 with respect to the opening 214, 224 of the through lane 212,222. The bump 314 is configured to fill the through lane 212,222 and the opening 214, 224 to ensure a firm assembling of each of the nose pads 3 with the through lane 212,222. In this embodiment, the anti-off body 321 is a sucker, e.g. a suction cup. In another possible embodiment, the anti-off body 321 may have an uneven surface or a grainy surface capable of adding friction, depending on the need. The sucker 321 has a base 322 and an arc pad 323 formed integrally with the base 322. The base 322 is integrally extended from the pillar 312 and has an area larger than the arc pad 323, so that when the nose clip structure 1 is in contact with the swimmer's nose, the base 322 can keep edges of the two arms 21,22 away from the swimmer's nose to avoid uncomfortable touch which the two arms 21,22 may cause. The arc pad 323 has a recess 324 that is adapted to the wing of the swimmer's nose for expelling air out of the arc pad 323, creating a negative pressure inside the nose pads 3 as the nose clip structure 1 is worn, which may assist the clamping of the two arms 21,22 and avoid the looseness and falling-off of the nose clip 1 in use.

Figure 2:
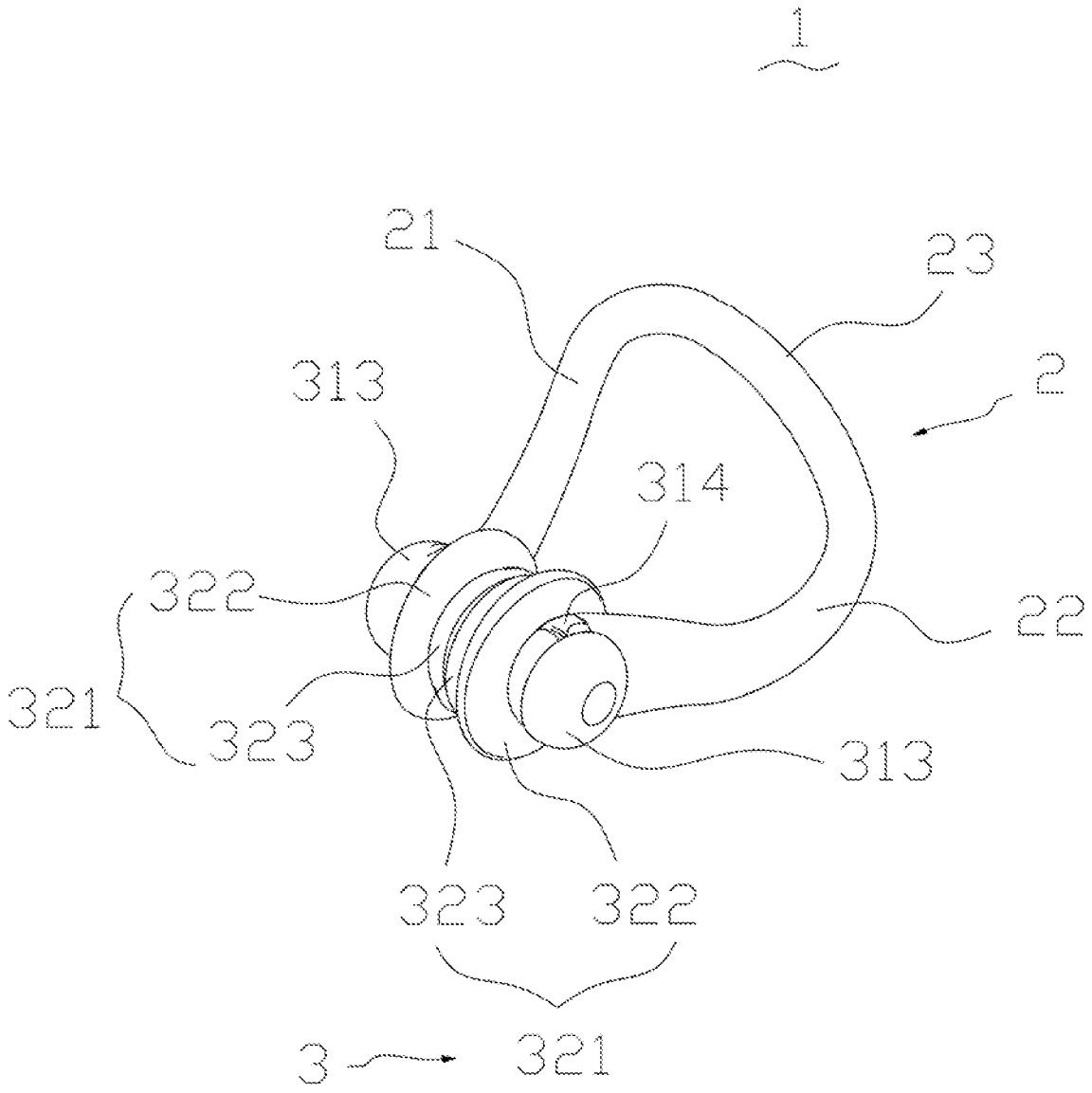
FIG. 2 is an assembled perspective view of the nose clip structure in accordance with the present invention.
Figure 3:
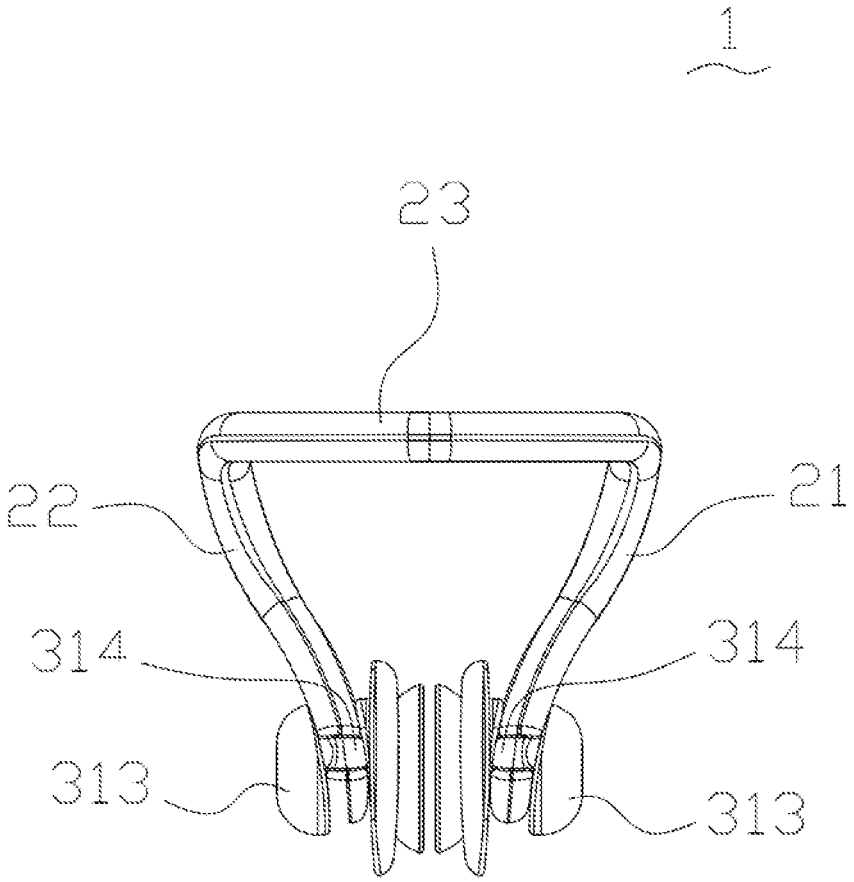
FIG. 3 is a front view of FIG. 2.
Figure 4A:
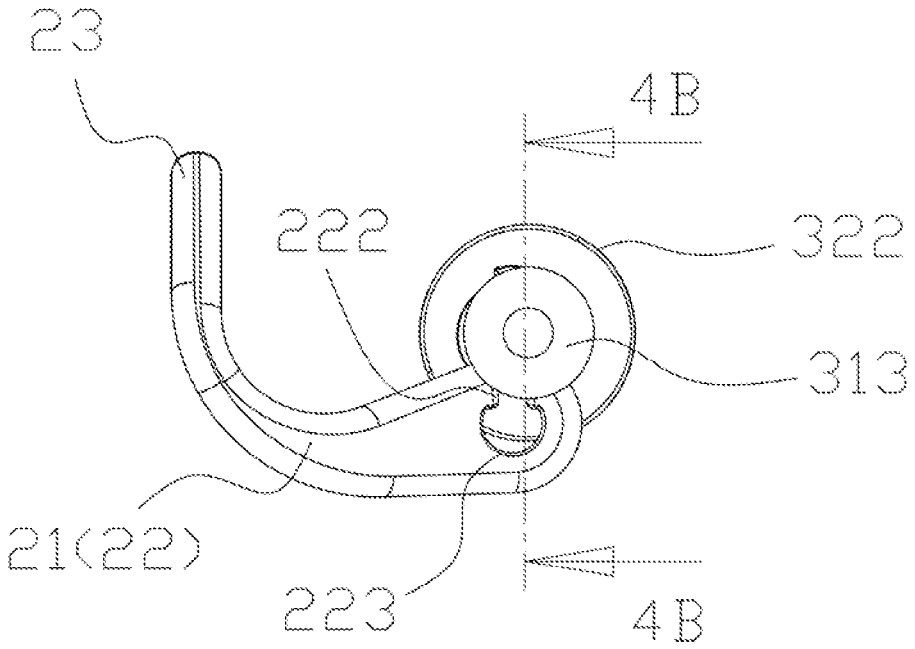
FIG. 4A is a lateral view of the nose clip structure in accordance with the present invention showing that the nose pad is assembled in the through lane of the mounting groove.
Figure 4B:
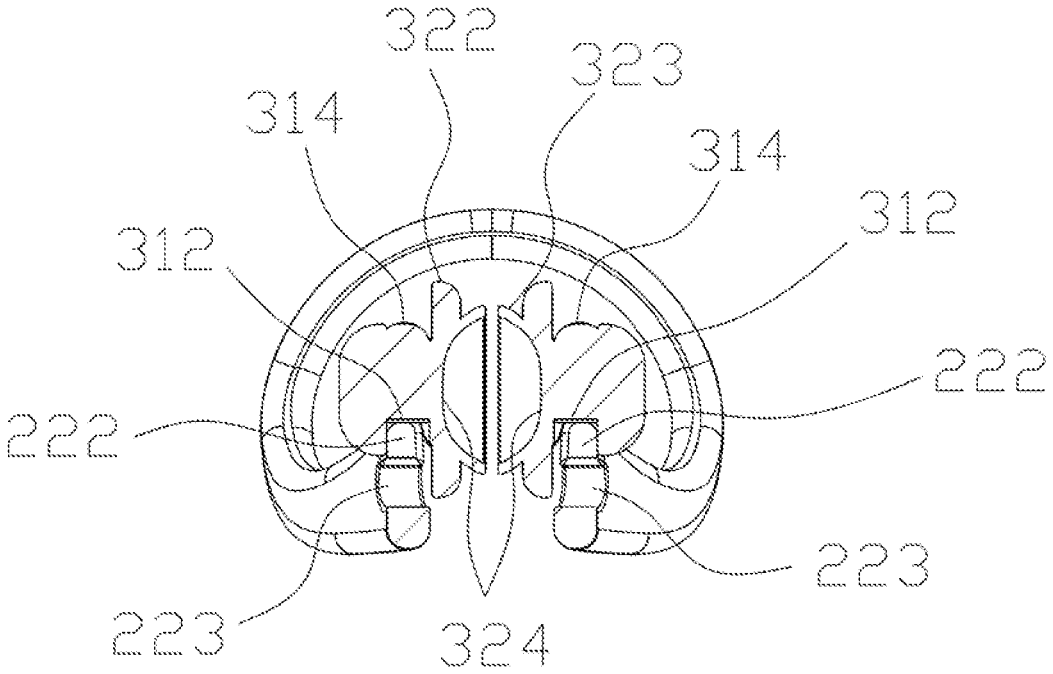
FIG. 4B is a cross-sectional view taken along line 4B-4B of FIG. 4A.

With reference to FIGS. 4A, 4B in view of FIGS. 1 and 2, when the nose clip structure 1 in accordance with the present invention is assembled, the pillar 312 is inserted from the through lane 212,222 to the hole 213,223, along the opening 214,224 of the end of the two arms 21,22, by means of the flexibility of the nose pads 3, and meanwhile, the bump 314 fills the through lane 212,222 and the opening 214,224 (FIG. 2), so as to ensure the firm assembling of the nose pads 3 with the through lane 212,222. After the assembling, the two arms 21,22 and the connecting portion 23 of the nose frame 2 in accordance with the present invention, form the arc contour that has a wide top and a narrow bottom (FIG. 3), so as to enhance the flexibility of the two arms 21,22 during bending, which provides a comfortable fit to a swimmer's nose. Next, the nose pads 3 in accordance with the present invention is adapted to engage with the wing of the swimmer's nose by the recess 324 (FIG. 4B) of the arc pad 323 of the anti-off body 321 which expels air and creates a negative pressure for the performance in sucking the wing of the swimmer's nose.

Figure 6:
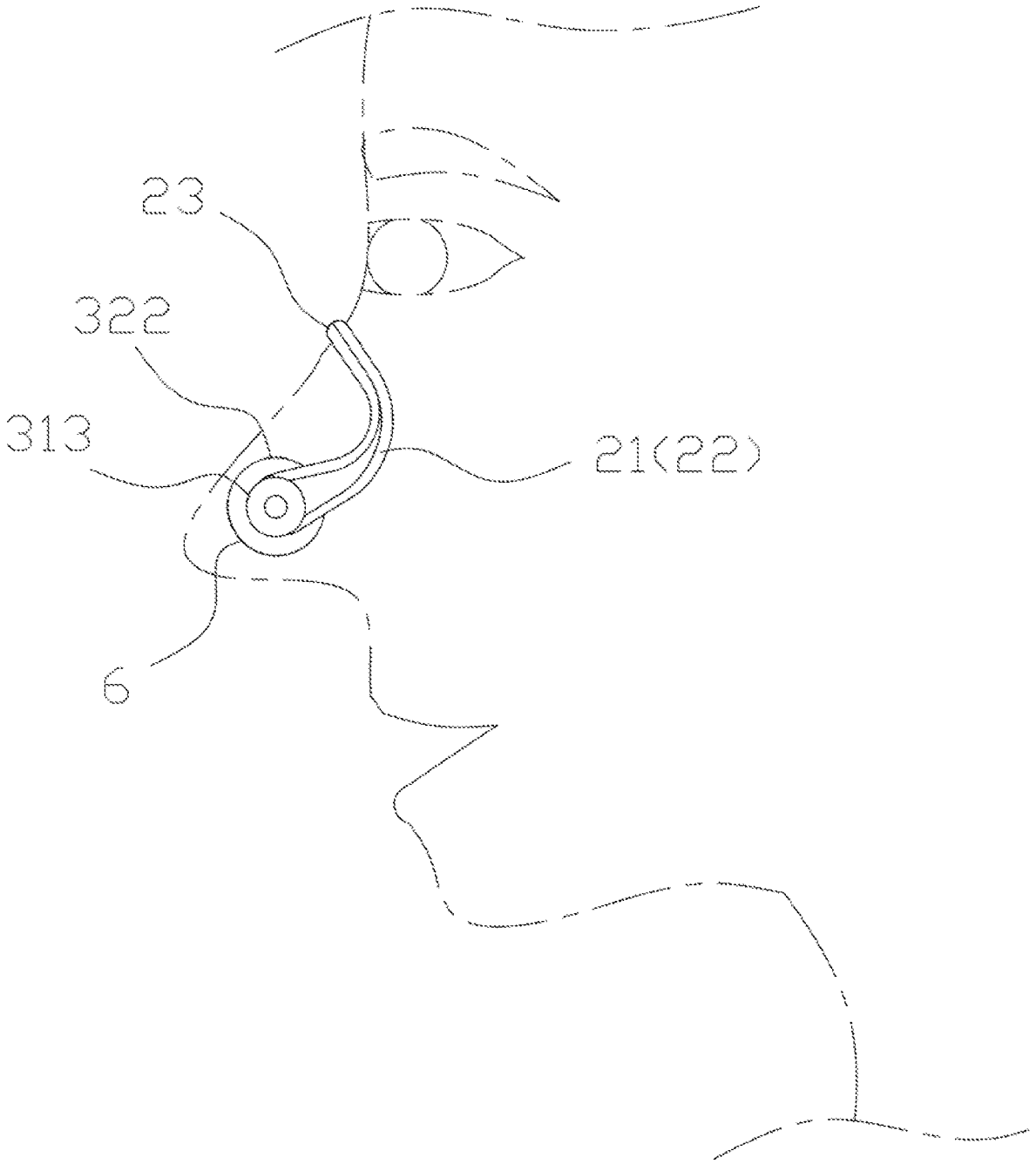
FIG. 6 is an application of the nose clip structure in accordance with the present invention showing that the nose clip is fit to the wing of the swimmer's nose.

With reference to FIGS. 5A and 5B in view of FIG. 6, when the nose clip structure 1 in accordance with the present invention is worn, the two arms 21,22 of the nose frame 2 are pulled outward toward the nose pads 3. In the meantime, the two arms 21,22 are provided with an energy storage, which is then released to provide a clip force on the wing of the swimmer's nose 6. The recess 324 of the arc pad 323 of the anti-off body 321 expels air and creates a negative pressure for the performance in sucking the wing of the swimmer's nose 6, which may assist the clamping of the two arms 21,22 and avoid the looseness and falling-off of the nose clip structure 1. Further, the connecting portion 23 of the nose frame 2 are designed in an arc shape that provides the two arms 21,22 to relatively bend in the flexible manner, which provides a comfortable fit to a swimmer's nose.

Figure 7:
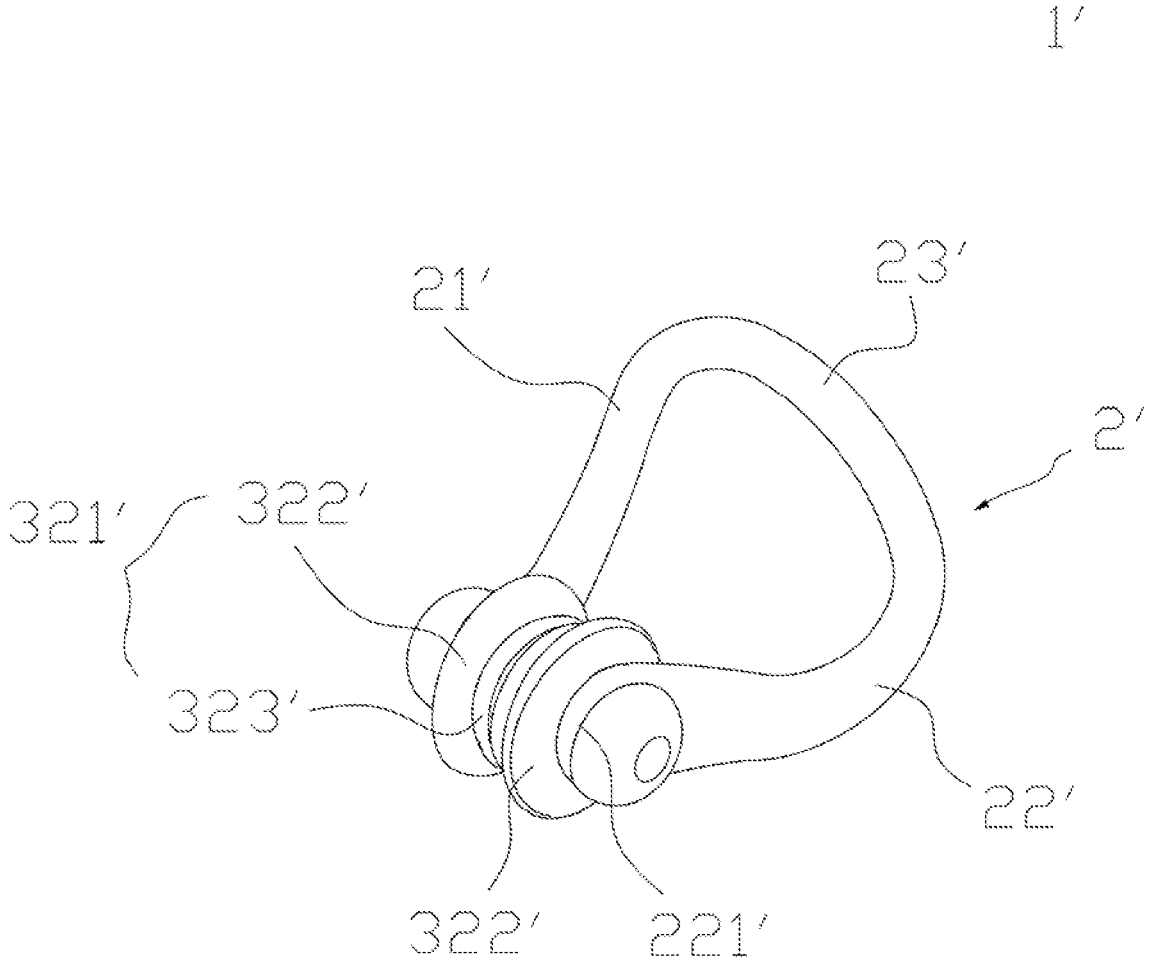
FIG. 7 is a perspective view showing a second embodiment of the nose clip structure in accordance with the present invention.

With reference to FIG. 7, which shows a second embodiment in accordance with the present invention, the nose clip structure 1' of the second embodiment of the present invention similarly includes the nose frame 2' and the nose pads 3'. The nose frame 2' is made of nylon and comprises the two arms 21',22' and the connecting portion 23' interconnecting the two arms 21',22'. The two arms 21',22', along with the connecting portion 23', form the arc contour that has a wide top and a narrow bottom, which enhances the flexibility of the two arms 21,22 during bending, so as to provide a comfortable fit to a swimmer's nose. The free end of each of the two arms 21',22' is disposed with the mounting groove 221'. The nose pads 3' are made of a soft material such as thermoplastic rubber or silicon. The anti-off body 321' is the sucker, and has the base 322' and the arc pad 323". It is noted that after the two arms 21',22' and the connecting portion 23' are integrally formed together, the base 322' and the arc pad 323' of the nose pads 3' of this embodiment are integrally formed on the free end of each of the two arms 21',22' through the mounting groove 211',221' in an over-molding injection mode or in a dual-injection mode. The nose clip structure 1' of this embodiment can also provide both clamping and sucking effects, thereby providing a secure and comfortable fit to a swimmer's nose.

It is understood that the invention may be embodied in other forms within the scope of the claims. Thus the present examples and embodiments are to be considered in all respects as illustrative, and not restrictive, of the invention defined by the claims.

What is claimed is:

1. A nose clip structure, adapted to fit to a swimmer's nose, comprising a nose frame and nose pads, wherein the nose frame, including two arms and a connecting portion, the connecting portion interconnecting the two arms to make the two arms bend flexibly;

the nose pads, disposed on the two arms of the nose frame, and having an anti-off body adapted to engage with the wing of the swimmer's nose to prevent falling-off of the nose clip structure;

wherein the anti-off body is a sucker having a base and an arc pad formed integrally with the base, and the arc pad has a recess, wherein an area of a side of the base facing toward the arc pad is lamer than an area of the recess of the arc pad.

2. The nose clip structure of claim 1, wherein the two arms are disposed with the suckers of the nose pads, wherein a free end of each of the two arms is disposed with a mounting groove, the mounting groove is composed of a through lane and a hole formed integrally with the through lane, the through lane has an opening, and each of the nose pads is disposed with a pillar and a head, wherein the pillar is assembled with the through lane and is integrally formed with the base of the sucker, and the head is formed integrally with the pillar.

3. The nose clip structure of claim 2, wherein a width of the through lane is smaller than an inner diameter of the hole, and a longitudinal sectional width of the pillar is larger than a width of the through lane, while a cross sectional width of the head is larger than an inner diameter of the hole of the through lane.

4. The nose clip structure of claim 1, wherein the two arms, along with the connecting portion, form an arc contour that has a wide top and a narrow bottom, and each of the two arms is shaped as an oblique arc, which enhances the flexibility of the two arms during bending, so as to provide a comfortable fit to the swimmer's nose.

5. The nose clip structure of claim 1, wherein the nose pads are integrally formed on the two arms in an over-molding injection mode or in a dual-injection mode.

6. The nose clip structure of claim 1, wherein the nose frame is made of nylon, and the nose pads are made of thermoplastic rubber or silicon.

* * * * *